United States Patent [19]

Auburn

[11] 4,177,522

[45] Dec. 11, 1979

[54] SURVIVAL BELT

[76] Inventor: Parker K. Auburn, 95 Dwight Pl., Englewood, N.J. 07631

[21] Appl. No.: 854,889

[22] Filed: Nov. 25, 1977

[51] Int. Cl.[2] ..... A41F 9/00

[52] U.S. Cl. ..... 2/338

[58] Field of Search ..... 2/338, 308, 320, 326, 2/337, 301, 319; 139/383; 28/149, 151, 152

[56] References Cited

U.S. PATENT DOCUMENTS

| | | | |
|---|---|---|---|
| 703,568 | 7/1902 | Gaisman et al. | 2/338 |
| 734,167 | 7/1903 | Gaisman | 2/338 |
| 1,141,665 | 6/1915 | Stewart | 139/383 R |
| 1,197,844 | 9/1916 | Muchmore | 2/319 X |
| 2,898,602 | 8/1959 | Moss | 2/301 |
| 3,142,844 | 8/1964 | Murray | 2/326 |
| 3,371,351 | 3/1968 | Allain | 2/338 |

FOREIGN PATENT DOCUMENTS

| | | | |
|---|---|---|---|
| 655308 | 12/1928 | France | 2/338 X |
| 1191890 | 4/1959 | France | 2/338 |
| 143454 | 12/1953 | Sweden | 28/152 |

OTHER PUBLICATIONS

German Printed Application, W. Kohl, K12744 V11/25b. 10-6-1955.

*Primary Examiner*—Dorsey Newton
*Attorney, Agent, or Firm*—Brumbaugh, Graves, Donohue & Raymond

[57] ABSTRACT

A belt is formed of a single piece of high strength nylon line approximately 50–100 feet long attached to a belt buckle by a series of longitudinal loops which constitute the warp strands of a woven band. The weft strands of the band are woven through the warp strands in a series of loops, each succeeding weft loop passing through the end of the previous weft loop. At the end of the longitudinal loops, the end of the cord is passed through the penultimate weft loop and is then woven back through the warp to releasably lock the weave. The belt may be rapidly converted to a long single length of survival line by merely pulling the end of the cord out of the warp and through the penultimate loop to unlock the weave which can then be completely unraveled in seconds to yield a long and strong survival line of great utility.

11 Claims, 3 Drawing Figures

SURVIVAL BELT

BACKGROUND OF THE INVENTION

This invention relates to an article having a utility such that an outdoorsman would be inclined to take it with him on an excursion, which article is made from a single length of high strength cord, and which can be unraveled to produce a long single length of survival line having great utility in emergency situations and particularly to a belt, for trousers and the like, of the same character.

There are many situations where a coil of survival line would be extremely desirable to have on hand. For example, in many camping, hiking, hunting and boating trips into remote areas the need for a coil of survival line may become manifest at the most unexpected and inopportune moments. For example, the outdoorsman may become lost and need a long length of line to lash together boughs to form a shelter, or to use for making small game snares or fishing line or netting to provide emergency food. Similarly, he could become trapped in a high or inaccessible place such as a ledge of a cliff or an area isolated by rain-swollen streams, and need a life line to assist him in traversing the danger zone to a safe place.

The need for a survival line can arise quite suddenly and it should be readily and immediately accessible. If the line is carried in a backpack, for example, the backpack must be present when the need for the line arises and it must be immediately accessible. There is no assurance that either of these conditions will obtain in all emergency situations. Moreover, most outdoorsmen, especially those who are backpacking their own gear to a remote location by foot, prefer to carry only the most necessary and indispensible equipment with them to minimize weight and volume. Thus, a survivalline is usually not included in the outdoorsmen's gear.

SUMMARY OF THE INVENTION

I have perceived therefore a need to provide a survival line in a form which an outdoorsman would not regard as an added burden. My solution is to form the survival line into an article which itself is so useful to the outdoorsman that he will usually take it with him, preferably on his person, regardless of its secondary utility. The article is woven from the survival line using a releasable weave so that, when an emergency situation arises necessitating the use of a survival line, the weave can be unlocked and the article in question can be quickly converted to a survival line.

consider a belt for trousers to be the best article to form from a length of survival line. Most outdoorsmen use a belt and do not regard it as burdensome to carry with them, even on the longest treks to the most remote locations. In an emergency situation, the belt will be immediately and readily available for conversion into a length of survival line.

Accordingly, it is an object of this invention to provide an article having a utility of its own which the outdoorsman will usually carry with him. The article is woven from a long length of survival line with a releasable weave that can be quickly unlocked and unraveled to convert the article into a single long length of survival line.

DESCRIPTION OF THE DRAWINGS

Other objects of the invention will become manifest upon consideration of the following written descriptions of the preferred embodiment of the invention together with consideration of the following drawings, wherein.

DESCRIPTION OF THE PREFERRED EMBODIMENT

Figure 1:
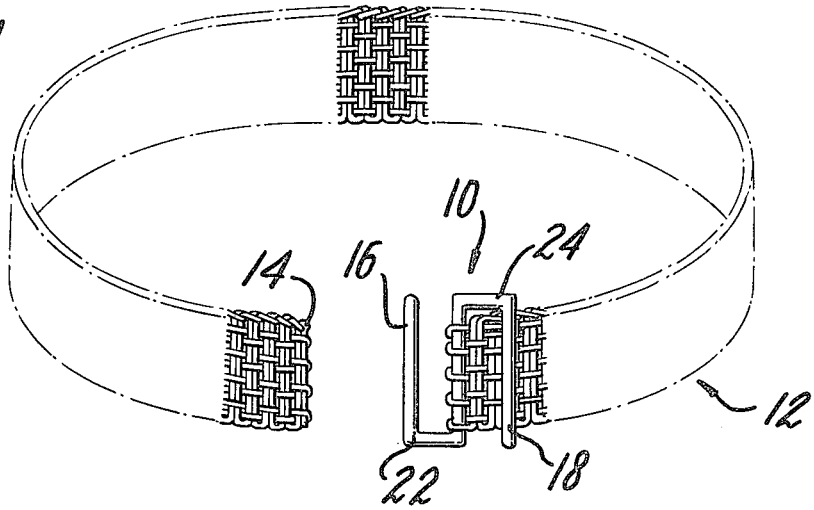
FIG. 1 is a perspective view of the invention embodied in a belt.

Referring now to the drawings wherein like reference characters designate identical or corresponding parts, and more particularly to FIG. 1 thereof, a belt embodying this invention is shown having a buckle 10 attached at one end of a web portion 12 which terminates in a distal or free end 14. The buckle 10 is formed from a single length of heavy steel rod stock, either chrome plated or stainless steel to resist corrosion. The buckle 10 has forward and rearward cross pieces 16 and 18, respectively, extending parallel to and spaced from a center cross piece 20. One end of the center cross piece 20 is connected to the corresponding piece 22, and the other end of the center cross piece 20 is connected to the corresponding end of the rearward cross piece 18 by a rearward connecting piece 24. The resulting structure is a squared S-shaped buckle of considerable strength, simplicity, and beauty which is very economical to manufacture and extremely durable and useful in operation, as will be explained below.

The web or band 12 of the belt is attached at one end to the center cross piece 20 of the buckle. The web is woven from a single length of high strength cord such as MIL-C-5040 type IV nylon. This cord, used as parachute risers, is strong enough so that a single length will support the weight of a heavy man; it is long enough, e.g. 50–100 feet, to be used in most emergency situations wherein a survival line is needed. The cord has a woven outer sheath of nylon surrounding an inner core of nylon cords which can be pulled from the cord and used for fishing or game snares.

I will now explain how the belt may be woven by hand. One end 26 of the cord is looped around the center cross piece 20 of the buckle 10 and tied in a knot 27 to form a loop 28 approximately 3 or 4 inches long. The bight portion of the cord is then formed in a longitudinal loop 30 of a length approximately 20% greater than the desired length of the belt, for example 36 inches for a finished length of 30 inches. The cord is passed over the center cross piece 20 of the buckle 10 adjacent the loop 28 and is formed in a second longitudinal loop 32 adjacent the loop 30. Additional longitudinal loops 33 and 34, or as many others as desired, are formed in sequence. The longitudinal loop cords form the warp cords in the woven web of the belt. Each loop gives approximately ¼ inch in width to the belt, so the belt illustrated is slightly over one inch in width.

After all the longitudinal loops 30–34 have been formed, the bight portion of the cord is formed in a loop 36 approximately 3 inches long and is woven through the warp cords formed by the longitudinal loops 30–34. The end of the loop 36 is left free, and a second loop 38 is formed in the bight portion of the cord and is woven through the warp cords immediately below and adjacent to the loop 36. The end of the loop 38 is passed through the end of the preceeding loop 36 and the bight end of the loop 36 is pulled snug to draw the loop tight around the end of the loop 38. A coarse comb or the like is used to push the cords of the loops 36 and 38 upwards toward the cross piece 20, snug against each other.

Figure 2:
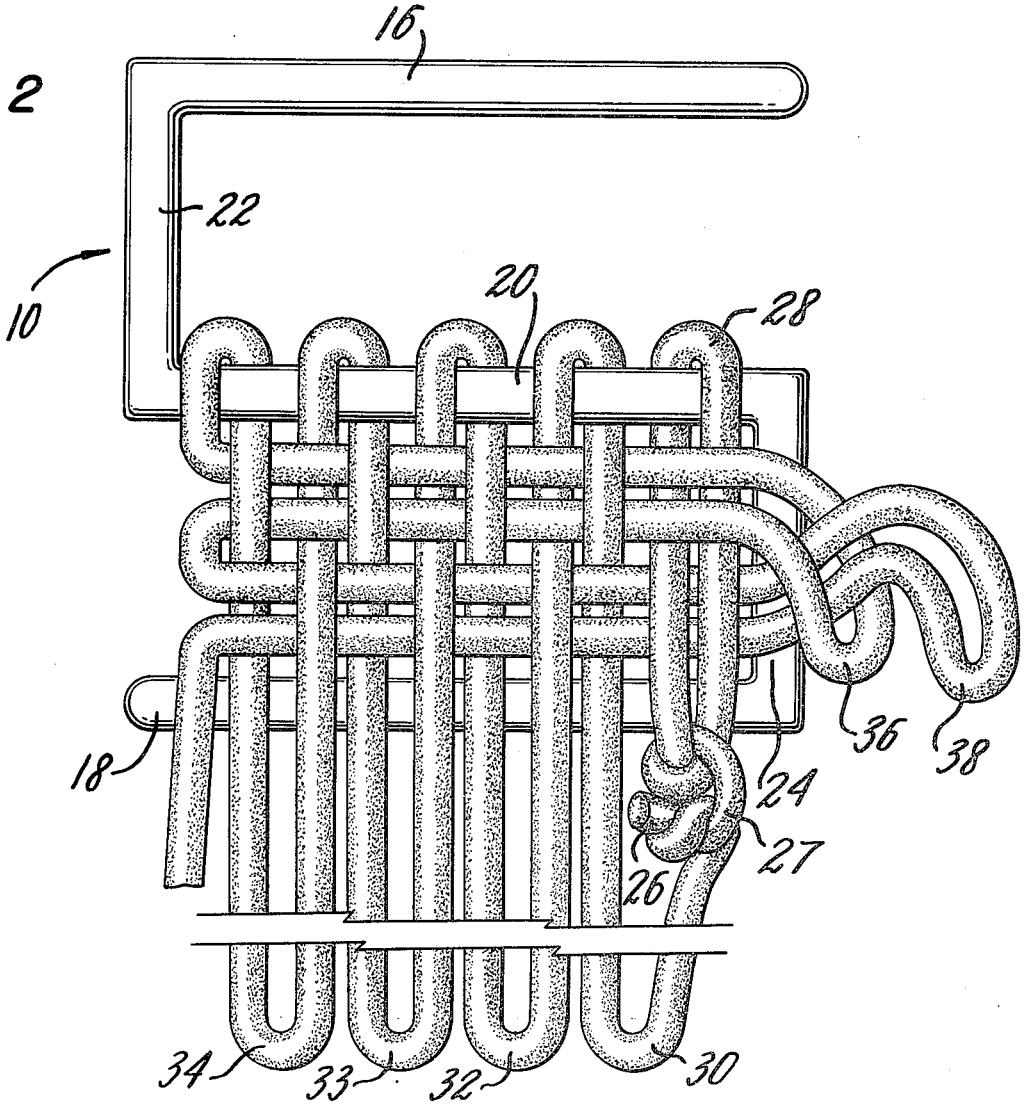
FIG. 2 is a plan view of the buckle end of the belt shown in FIG. 1 in partially woven condition.

A third loop (not shown in FIG. 2) is then formed and woven through the warp cords of the longitudinal loops 30–34 adjacent and immediately below the loop 38. The end of this third loop is passed through the end of the loop 38 in the same manner that the loop 38 was passed through the end of the loop 36. The bight portion of the loop 38 is pulled snug and the coarse comb is again used to push the cords of the lateral loops upwards against each other toward the center cross piece 20 of the belt 10.

The weaving is continued in this manner using successive lateral loops each of which is woven through the warp cords of the longitudinal loops and passed through the end of the immediately preceeding loop to hold it in place and prevent its pulling back through the warp cords.

After a sufficient number of lateral weft loops have been woven to pass below the knot 27, the end 26 of the cord immediately above the knot may be cut and the knot may be untied from the cord. The loop 28 will not pull out at this point because the weaving will hold it in place. The end 26 of the cord may then be tucked into the weave and will be entirely obscured and will not be noticed in the final belt.

The weaving is continued until there is just room for one more lateral loop at the lower end of the longitudinal loops 30–34. Then, instead of weaving the last loop through the warp cords of the loops 30 through 34, the end 40 of the cord is woven through the warp cords and is passed through the end of the preceeding lateral loop. The end 40 of the cord is then woven back through the warp cords, forming at this point in the weave a very snug fit. After the end is passed through the last longitudinal loop 34 it is cut off flush, thus completing the weaving of the belt.

Figure 3:
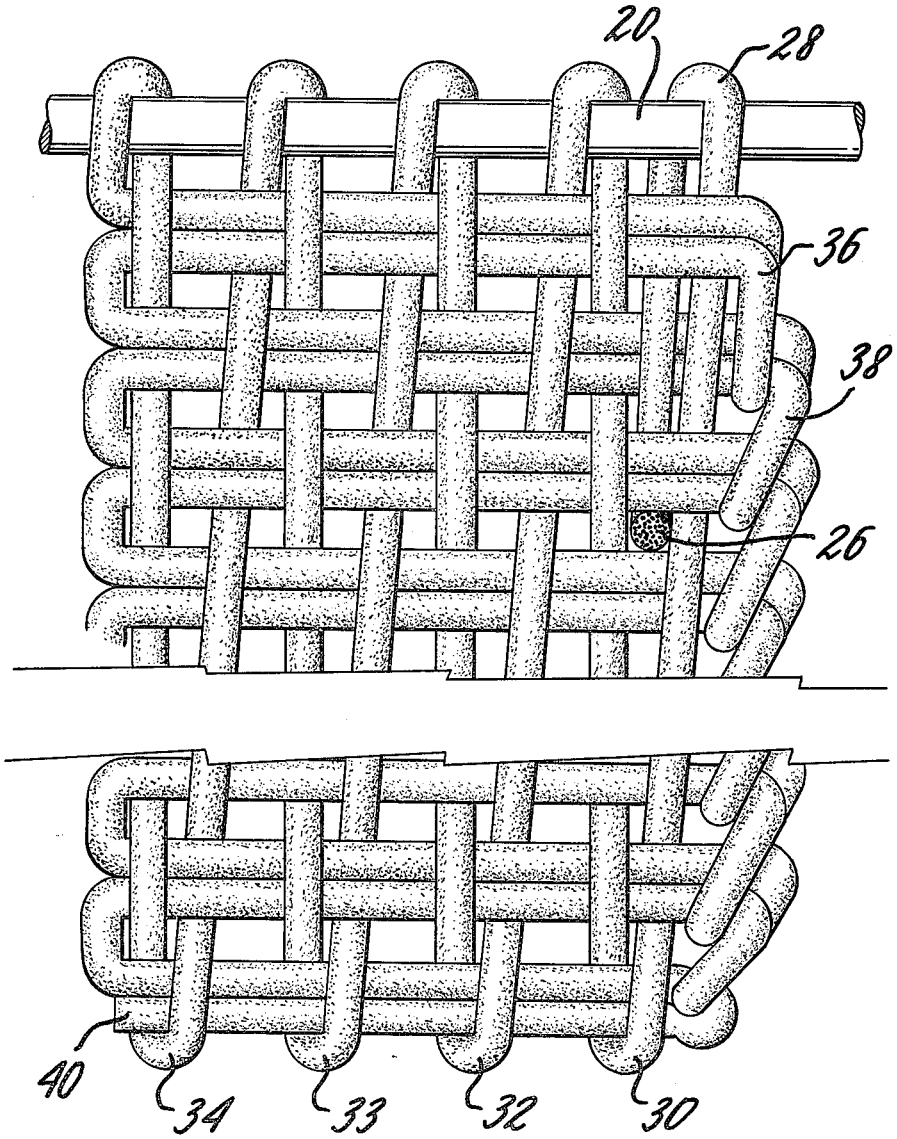
FIG. 3 is an enlarged plan view of the two ends of the belt with the center portion broken away for clarity of illustration.

In an emergency situation where a lifeline is needed, the belt can be removed from the trousers of the wearer and the end 40 of the line can be pulled to the right, in FIG. 3, out of the ends of the longitudinal loops 30–34 and then back through the end of the preceeding lateral loop and to the left through the loops 30–34 again. The cord then is merely pulled and the penultimate lateral loop, which has now been unlocked will pull through the warp cords, thereby unlocking the antipenultimate lateral loop. Continued pulling on the cord will pull the antipenultimate loops through the warp cords thereby unlocking the next preceedling loop. In this way, the weave readily unravels by merely continued pulling on the end until all the lateral loops have been pulled through the warp cords. Nothing now remains except the longitudinal loops which are quickly pulled from the center cross piece 20 of the buckle to provide a long emergency lifeline completey detached from the buckle. The entire unraveling operation can be completed in a matter of seconds to provide, almost instantly, a lifeline for emergency situations.

The buckle 10 may be used as a rappel link by merely winding the cord around the center section 20 four to five turns. The speed of descent during rappelling may be controlled easily by the pressure on the bight portion of the cord exerted on the winding.

After the emergency situation has been resolved, the line may be rewoven in a band back on to the buckle again to resume its function as a belt.

The belt disclosed is minutely adjustable. The distal end of the belt 14 is passed under the forward cross piece 16, over the center cross piece 20 and under the rearward cross piece 18. It holds its adjustment partially because the cross pieces 16 and 18 lie in the lateral valleys or grooves between adjacent lateral loops of the weave to provide sufficient longitudinal force to prevent the end of the belt from slipping along the buckle 10. Additionally, the outward force exerted by the band on cross piece 16 causes the cross piece 18 to bear inwardly against the distal end 14 of the belt, pressing the two ends of the belt firmly together to provide a frictional force which prevents the end 14 of the belt from pulling out of the buckle.

The belt, according to this invention, is formed of only two pieces of material, namely the buckle 10 and the length of cord forming the woven band 12. It can be manufactured very economically with relatively unskilled labor and indeed may be rewoven by the user after its use as an emergency line. It is extremly attractive and comfortable when woven into a web of an inch or an inch and a quarter in width and produces a belt which is durable in use, dries quickly if it becomes wet and is dimensionally stable under all conditions of use The invention may also be embodied in forms other than the belt disclosed herein. For example, the harness of a backpack, normally woven in a nylon web may be replaced with a detachable web such as the web 12 of the illustrated belt. Other desirable forms include a wrist band or hat band, made in accordance with the invention. Therefore, it is to be expressly understood that the invention may take other forms than that illustrated herein and that the scope of the invention is to be defined by the appended claims, wherein:

I claim:

1. A belt, which may be quickly converted into a single length of cord having sufficient strength for supporting the weight of a person, comprising:

a buckle having at least one cross piece;

a web woven from a single length of cord formed into approximately 3–10 loops approximately 2–4 feet long, each loop passing over said cross piece, said loops forming a plurality of warp strands;

the bight of said cord, remaining after formation of said loops, being woven in weft loops through said warp strands as pairs of weft strands, each succeeding weft loop passing through the end of the previous weft loop;

the end of the cord in the last weft loop being passed through the penultimate weft loop and then woven back through the warp to releasably lock the weave;

whereby the end of the cord may be pulled out of the warp and through the penultimate loop to unlock the weave which can then be quickly unwoven by pulling on the cord to convert the belt into a long single length of survival line.

2. The belt defined in claim 1, wherein:

said buckle further comprises two additional cross pieces, one on either side of said one cross piece;

the distal end of said web remote from said buckle, in use as a belt, being passed under one said additional cross piece and over said one cross piece and under second additional cross piece to firmly and releasably hold said distal end in relation to said belt.

3. The belt defined in claim 1, wherein said web is free at the distal end, remote from said buckle and is releasably woven onto said buckle, so that said cord detaches from said buckle when said web is completely unraveled.

4. The belt defined in claim 1, wherein said cord comprises a braided nylon sheath enclosing a plurality of interior cords.

5. The belt defined in claim 4, wherein said cord is substantially similar to MIL-C-5040 type IV nylon.

6. A convertible supporting band, comprising:

a connector;

an elongated web having one end attached to said connector, and a distal end which is free;

said web being woven from a single length of cord having a tensil strength of greater than 500 lb. and a length of more than 50 feet;

said web being woven using a releasable weave which can be released by pulling the end of the cord out of the weave, whereupon the web can be completely unraveled in less than 10 seconds, to provide a long single length of survival line.

7. The convertible band defined in claim 6, wherein said connector is a buckle having at least two cross pieces, said web being attached to one of said cross pieces by a series of loops which pass over said one cross piece.

8. The convertible band defined in claim 7, wherein said releasable weave is formed of a series of longitudinal loops, through which are woven a series of lateral loops, each lateral loop passing through the end of the preceeding lateral loop to releasably hold it in place against pulling laterally out of the weave.

9. The convertible band defined in claim 6, wherein said connector comprises a buckle having a squared S-shaped structure including:

a center cross piece and two end cross pieces, said cross pieces extending laterally and being longitudinally spaced apart in the direction of elongation of said web;

a first longitudinal side piece interconnecting one end of the center cross piece and the corresponding end of one end piece.

a second longitudinal side piece interconnecting the other end of said center cross piece and the corresponding end of the other end piece.

10. The convertible band defined in claim 9, wherein:

said web is connected to said buckle by a plurality of longitudinally extending loops of said cord passing around said center cross piece;

whereby said band may be used to encircle articles of various circumferences and be held by said buckle by passing said distal end of said band under said end cross pieces and over said center cross piece to firmly, and minutely adjustably, hold said distal end in relation to said buckle.

11. A band convertible to an emergency line for supporting a person's weight, the band including a woven web of cord and a connector at at least one end of the band, the cord being woven in a releasable weave terminating in a cord end adapted to pull freeof the weave, said cord end forming means for unweaving the web by continued pulling of the freed cord end and the cord being released, the woven web comprised of plural longitudinal warp loops and plural lateral weft loops along the length of the web, said warp and weft loops being integral portions of the same cord, one end of each weft loop being serially releasably interlocked with the end of another weft loop and the final weft loop terminating in said cord end adapted to pull free, said end being slidably retained by engaging segments of the woven cord, and said end releasably retaining the end of an adjacent weft loop by removably passing through the loop, said end being slidable through the warp loops of the web and through said adjacent weft loop to release said adjacent weft loop and allow continued releasing of the weave.

* * * * *

UNITED STATES PATENT OFFICE

CERTIFICATE OF CORRECTION

Patent No. 4,177,522 Dated December 11, 1979

Inventor(s) Parker Auburn

It is certified that error appears in the above-identified patent and that said Letters Patent are hereby corrected as shown below:

Column 1, line 39, "survivalline" should be -- survival line--; column 1, line 54, before "consider" insert -- I --; column 1, lines 55-61 should be brought out to the left margin; column 2, line 47, after "snares.",insert -- See Fig.3, cord end 26. --;

column 6, line 23, "freeof" should be -- free of --.

Signed and Sealed this

*Eighth* Day of *April 1980*

[SEAL]

*Attest:*

SIDNEY A. DIAMOND

*Attesting Officer*

*Commissioner of Patents and Trademarks*